United States Patent [19]

Sperry et al.

[11] 4,062,704

[45] Dec. 13, 1977

[54] ALUMINUM ALLOYS POSSESSING IMPROVED RESISTANCE WELDABILITY

[75] Inventors: Philip R. Sperry, North Haven, Conn.; William C. Setzer, Creve Coeur, Mo.; Lloyd E. Damon, Wallingford, Conn.

[73] Assignee: Swiss Aluminium Ltd., Chippis, Switzerland

[21] Appl. No.: 704,018

[22] Filed: July 9, 1976

[51] Int. Cl.[2] ..... C22C 21/16

[52] U.S. Cl. ..... 148/32; 75/141; 75/142; 148/32.5

[58] Field of Search ..... 75/142, 147, 141; 148/32, 32.5

[56] References Cited

U.S. PATENT DOCUMENTS

| | | | |
|---|---|---|---|
| 2,076,569 | 4/1937 | Kempf et al. | 74/142 |
| 2,123,886 | 7/1938 | Fischer | 148/32 |
| 2,522,575 | 9/1950 | Hall et al. | 75/142 X |
| 2,749,239 | 6/1956 | Sicha et al. | 75/142 |
| 2,784,126 | 3/1957 | Criner | 75/147 X |
| 2,976,142 | 3/1961 | Maxwell | 75/142 |
| 3,826,688 | 7/1974 | Levy | 75/142 X |
| 3,935,007 | 1/1976 | Baba et al. | 75/142 |
| 3,938,991 | 2/1976 | Sperry et al. | 75/142 X |

*Primary Examiner*—R. Dean

*Attorney, Agent, or Firm*—Robert H. Bachman; Robert A. Dawson

[57] ABSTRACT

Aluminum alloys exhibiting improved resistance weldability are prepared which comprise 1.9–5.5% copper, up to 1.5% iron, up to 1.2% silicon, up to 1.2% manganese, 0.02–2.0% magnesium, and from 0.03–0.20% vanadium, balance essentially aluminum. The alloys of the present invention are particularly suited for automotive metal working applications.

12 Claims, No Drawings

ALUMINUM ALLOYS POSSESSING IMPROVED RESISTANCE WELDABILITY

BACKGROUND OF THE INVENTION

The present invention relates to the preparation of aluminium alloys useful in automotive metal working applications, and particularly relates to the provision of alloys possesssing improved resistance weldability.

Certain aluminum alloys have long been useful in applications such as the aircraft industry where extended sheets of material are joined to prepare a vehicle structure or body by resistance spot welding. Particularly in the aircraft industry, the technique of resistance spot welding has been highly developed where costs of the required equipment and elaborate production controls can be justified.

Two physical properties of aluminum are important in the practice of resistance spot welding. The first of these properties is the electrical resistivity which is known to be low by comparison with well-known steels, and therefore requires high welding currents to generate enough heat to make the weld. The other property comprises contact resistance existing at the surface of the metal, which, if excessively high and variable, causes pick-up or sticking of the metal to the welding electrodes, as well as extreme variability in the size, shape and strength of the resulting weld.

With the recent concern over energy consumption, the automotive industry has reviewed the types of materials being employed in substantial amounts in the structure of motor vehicles to determine whether efficiencies in weight reduction can be achieved by the selection of alternate materials. As the result, aluminum sheet alloys, which have characteristically found use in the aircraft industry, as well as alloys with more moderate strength and greater formability, are being investigated because of their reduced weight, corrosion resistance, and other favorable properties. An important factor, however, in the consideration of aluminum is its amenability to the resistance welding techniques presently useful with the steels currently employed. Thus, the ease of resistance welding in terms of minimal control and lower current requirements comprises an important factor which renders it desirable to tailor aluminum alloys to exhibit improved resistance weldability. One of the observations that has been made is that an increase in the bulk resistivity of the metal appears necessary, as it reduces total current requirements and makes contact resistances less critical.

SUMMARY OF THE INVENTION

In accordance with this invention, aluminum alloys possessing improved resistance weldability are prepared which comprise 1.5–7.0% copper, 0.25–1.5% iron, 0.2–1.2% silicon, 0.2–1.2% manganese, 0.02–2.0% magnesium, and from 0.03–0.20% vanadium, balance essentially aluminum.

The alloys of the present invention exhibit decreases in conductivity on the order of 5% as measured in % IACS over comparable commercial alloys not containing vanadium in the above amounts, and are particularly suited for automotive metal applications. Further, the performance of vanadium in the above amounts contributes to desirable ductility and formability by its entry into solid solution in the alloy.

A further advantage of the present invention is that the alloys may be processed in accordance with standard mill practice including employment of the faster DC casting technique, and do not require rigorous conditions for favorable results.

Accordingly, it is a principal object of the present invention to provide aluminum base alloys suitable for automotive metal working applications which exhibit improved resistance weldability.

It is a further object of the present invention to provide aluminum base alloys as aforesaid which achieve improved resistivity with the retention of desirable ductility and formability.

It is yet a further object of the present invention to provide aluminum base alloys as aforesaid which may be prepared by processes employing DC casting techniques.

Further objects and advantages will be apparent from a consideration of the ensuing description.

DETAILED DESCRIPTION

In accordance with the present invention, the foregoing objects and advantages are readily attained.

The aluminum base alloys of the present invention comprise, in weight percent, from 1.9–5.5% copper, up to 1.5% iron, up to 1.2% silicon, up to 1.2% manganese, from 0.02–2.0% magnesium, and from 0.03–0.20% vanadium, balance essentially aluminum. In a preferred embodiment, the alloys of the present invention may contain from 2.2–3.0% copper, from 0.25–0.5% iron, from 0.2–0.5% silicon, from 0.10–0.40% manganese, from 0.3–0.6% magnesium and from 0.03–0.20% vanadium.

The aluminum base alloys prepared in accordance with the present invention are those which are designated as the 2000 Series alloys by the Aluminum Association. In addition to the elements stated above, the alloys of the present invention may provide the following additives: chromium up to 0.10%, nickel up to 2.3%, zinc up to 0.3%, zirconium up to 0.15% and titanium up to 0.2%. As a general rule, additives and other impurity elements may be present in amounts of about 0.05% each and totaling 0.15%, not adversely affecting the properties of the alloy.

As noted above, it has been found in accordance with the present invention that the aluminum base alloys of the 2000 Series to which vanadium has been added in the above stated amounts possess improved resistance weldability by virtue of the increase of the resistivity of the alloy. This stems partly from the fact that vanadium confers a relatively strong incremental increase in resistivity (3.50 Ω – cm per weight percent) and is capable of remaining in saturated solid solution in the alloy. Further, it does not affect or alter the basic characteristics of the alloy such as melting range, corrosion resistance, finishing characteristics or the like.

The 2000 Series alloys possess characteristics favorable for use in auto body applications which derive from the elements comprising the primary alloying ingredients. Thus, copper is a major alloy ingredient which confers a strengthening effect due to both solid solution hardening and precipitation hardening. Magnesium is added to accelerate age hardening at room temperature, and the small addition of manganese improves strength slightly without sacrificing ductility. A particular alloy of the 2000 Series which appears to possess great potential in automotive applications is designated by the Aluminum Association as Alloy 2036 which broadly comprises from 2.2 to about 3.0% copper, from about 0.25 to about 0.50% iron, from about 0.2 to about 0.50% silicon, from about 0.10 to about 0.40% manganese, from about 0.30 to about 0.60% magnesium, balance essentially aluminum. This alloy may further contain up to about 0.10% chromium, up to about 0.15% zirconium, up to about 0.25% zinc and up to about 0.15% titanium, as well as other impurities in amounts of up to 0.5%, the total not exceeding 0.15%, which would not materially affect the properties of the composition. As with other members of the 2000 Series, Alloy 2036 exhibits improved resistivity as the result of the addition of vanadium in an amount ranging from 0.03 to 0.20%.

The alloys of the present invention may be processed in accordance with conventional practices and techniques. Thus, the faster DC casting technique may be employed and the alloys may be hot worked, such as by hot rolling, at temperatures such as, for example, 800° F, and cold worked as, for example, by cold rolling to reductions of, for example, 50% or greater. Such processing may be conducted in a manner well-known to those skilled in the art, and need not be further discussed herein.

In addition to the ease of processing, the alloys of this invention possess improved tensile properties, ductility and formability which are comparably to acceptable levels achieved by conventional alloys. Most importantly, conductivity measurements show that much or all of the vanadium present in the alloys is retained in solid solution in the solution heat treated condition, with the result that the vanadium containing alloys were found to possess reduced levels of conductivity, corresponding with increased resistivity, by comparison with alloys which contained no vanadium.

The present invention will be more readily apparent from a consideration of the following illustrative examples.

EXAMPLE I

In this example in aluminum base alloy of the 2000 Series comprising Alloy 2036 was prepared, together with a comparative alloy containing vanadium. The alloys possessed the nominal compositions set forth in Table I, below.

TABLE I

| Alloy Number | COMPOSITION (WEIGHT %) | | | | | | | |
|---|---|---|---|---|---|---|---|---|
| | Si | Fe | Cu | Mn | Mg | V | Ti | Al |
| 1 | .15 | .25 | 2.6 | .25 | .45 | — | .02 | Bal. |
| 2 | .15 | .25 | 2.6 | .25 | .45 | .18 | .02 | Bal. |

The above alloys were cast by the Durville method, after which they were homogenized by heating at a rate of 50° F per hour from a temperature of 600° to 975° F. The alloys were held at this temperature for 10 hours and were then air cooled at a rate of 50° F per hour to a temperature of 850° F. The alloys were then hot rolled at 800° F to a thickness of 0.200 inches, and were then cold rolled to 0.080 inches. The alloys were then solution heat treated at 900° F for 30 minutes, after which they were placed in a water quench. The alloys were then aged at room temperature for 4 days, and were subsequently tested for tensile properties, formability in terms of the plastic strain ration, R, defining resistance to thinning of the metal sheet or strip, and conductivity. The results are set forth in Table II, below.

TABLE II

| Alloy No. | Effect of Vanadium on Mechanical Properties and Conductivity | | | | |
|---|---|---|---|---|---|
| | Longitudinal Tensile Properties | | | Electrical Conductivity | |
| | YS (ksi) | UTS (ksi) | Elong. (%) | % IACS | $\bar{R}$ Value |
| 1 | 29.6 | 50.6 | 21.5 | 38.3 | 0.733 |
| 2 | 29.8 | 50.1 | 22.8 | 33.6 | 0.768 |

From the above Table, it can be seen that the alloy sample prepared containing vanadium had tensile properties which compared favorably with those of the identical alloy containing no vanadium. Further, the measurements of plastic strain ratio which suggest relative formabilities show that both alloys were substantially similar in terms of their resistance to thinning. Thus, the alloys prepared in accordance with the present invention appear to substantially retain all of the characteristic properties exhibited by the same alloys to which vanadium was not added.

A comparison of the conductivities of the respective samples, as measured in percent IACS reveals that the alloys of the present invention possess a conductivity which is lower by approximately 5% IACS. This reduction in conductivity is significant as it indicates a corresponding increase in resistivity which is substantial. Thus, the alloys of the present invention would be capable of forming into wrought articles such as automotive body sheets which require significant plastic deformation with the same facility as that of comparable alloys to which vanadium is not added. Additionally, and most importantly, the alloys of the present invention are capable of resistance welding with greater ease and reliability, as the aforenoted vanadium addition significantly reduces conductivity whereby a corresponding increase in resistivity is achieved. As noted earlier, this improvement is believed to be the result of the unique ability of vanadium to enter and remain in saturated solid solution in the formed alloy whereby formability and tensile properties of the alloys are not diminished and conductivity is effectively reduced.

Unless otherwise specified, all percentages of elements recited herein are expressed in percent by weight.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A wrought article exhibiting reduced electrical conductivity, increased electrical resistivity, improved resistance weldability plus good tensile properties prepared from an aluminum base alloy consisting essentially of from 2.2 to 3.0% copper, up to 1.5% iron, up to 1.2% silicon, up to 1.2% manganese, from 0.02 to 2.0% magnesium, and from 0.03 to 0.20% vanadium, balance aluminum, wherein vanadium is retained in solid solution.

2. The article of claim 1 wherein said alloy in addition consists of up to 0.10% chromium, up to 2.3% nickel, up to 0.3% zinc, up to 0.15% zirconium, up to 0.2% titanium, and others up to 0.05% each, total up to 0.15%.

3. The article of claim 1 wherein said alloy consists essentially of from 0.25 to 0.50% iron, from 0.2 to 0.50% silicon, from 0.10 to 0.40% manganese, and from 0.30 to 0.60% magnesium.

4. The article of claim 3 wherein said alloy in addition consists of up to 0.10% chromium, up to 0.15% zirconium, up to 0.25% zinc, up to 0.15% titanium, and others up to 0.05% each, total up to 0.15%.

5. The article of claim 1 wherein said alloy is in the annealed condition.

6. The article of claim 1 wherein said alloy is in the annealed and cold worked condition.

7. A resistance welded article having reduced electrical conductivity, increased electrical resistivity, improved resistance weldability plus good tensile properties prepared from an aluminum base alloy consisting essentially of from 2.2 to 3.0% copper, up to 1.5% iron, up to 1.2% silicon, up to 1.2% manganese, from 0.02 to 2.0% magnesium, and from 0.03 to 0.20% vanadium, balance aluminum, wherein vanadium is retained in solid solution.

8. The article of claim 7 wherein said alloy in addition consists of up to 0.10% chromium, up to 2.3% nickel, up to 0.3% zinc, up to 0.15% zirconium, up to 0.2% titanium, and others up to 0.05% each, total up to 0.15%.

9. The article of claim 7 wherein said alloy consists essentially of from 0.25 to 0.50% iron, from 0.2 to 0.50% silicon, from 0.10 to 0.40% manganese, and from 0.30 to 0.60% magnesium.

10. The article of claim 9 wherein said alloy in addition consists of up to 0.10% chromium, up to 0.15% zirconium, up to 0.25% zinc, up to 0.15% titanium, and others up to 0.05% each, total up to 0.15%.

11. The article of claim 7 wherein said alloy is in the annealed condition.

12. The article of claim 7 wherein said alloy is in the annealed and cold worked condition.

* * * * *